US007534340B2

(12) United States Patent
Calemma et al.

(10) Patent No.: US 7,534,340 B2
(45) Date of Patent: May 19, 2009

(54) PROCESS FOR THE PREPARATION OF MIDDLE DISTILLATES AND LUBE BASES STARTING FROM SYNTHETIC HYDROCARBON FEEDSTOCKS

(75) Inventors: Vincenzo Calemma, San Donato Milanese-Milano (IT); Cristina Flego, Milan (IT); Luciano Cosimo Carluccio, San Donato Milanese-Milano (IT); Wallace Parker, Peschiera Borromeo-Milano (IT); Roberto Giardino, Besate-Milano (IT); Giovanni Faraci, San Donato Milanese-Milano (IT)

(73) Assignees: ENI S.p.A., Rome (IT); Institute Francais du Petrole, Rueil Malmaison (FR); Enitecnologie S.p.A., San Donato Milanese-Milano (IT)

( * ) Notice: Subject to any disclaimer, the term of this patent is extended or adjusted under 35 U.S.C. 154(b) by 88 days.

(21) Appl. No.: 10/563,449

(22) PCT Filed: Jun. 28, 2004

(86) PCT No.: PCT/EP2004/006979

§ 371 (c)(1),
(2), (4) Date: Apr. 20, 2006

(87) PCT Pub. No.: WO2005/003262

PCT Pub. Date: Jan. 13, 2005

(65) Prior Publication Data

US 2006/0231460 A1 Oct. 19, 2006

(30) Foreign Application Priority Data

Jul. 3, 2003 (IT) ..... MI2003A1361

(51) Int. Cl.

| | |
|---|---|
| ***C10G 47/00*** | (2006.01) |
| ***C10G 45/00*** | (2006.01) |
| ***C10G 7/00*** | (2006.01) |
| ***C07C 4/02*** | (2006.01) |
| ***C07C 5/22*** | (2006.01) |
| ***B01J 21/00*** | (2006.01) |

(52) U.S. Cl. ..... 208/107; 208/111.01; 208/106; 208/92; 208/230; 585/648; 585/652; 585/250; 585/253; 585/257; 585/275; 585/277; 585/500; 585/708; 585/709; 502/250; 502/253

(58) Field of Classification Search ..... 208/107, 208/106, 50, 53, 54, 59, 67, 72, 73, 80, 130, 208/230, 92; 585/648, 652, 921, 250, 253, 585/257, 275, 277, 500, 708, 709; 502/250, 502/253

See application file for complete search history.

(56) References Cited

U.S. PATENT DOCUMENTS 4,122,023 A * 10/1978 Yasui et al. ..... 424/64

(Continued)

FOREIGN PATENT DOCUMENTS

| | | | |
|---|---|---|---|
| EP | 1 101 813 | | 5/2001 |
| WO | WO-0248289 | * | 6/2002 |

*Primary Examiner*—Walter D Griffin
*Assistant Examiner*—Huy-Tram Nguyen
(74) *Attorney, Agent, or Firm*—Oblon, Spivak, McClelland, Maier & Neustadt, P.C.

(57) ABSTRACT

Process for the contemporaneous production of fuels and lubricating bases from synthetic paraffinic mixtures, which includes a hydrocracking step in the presence of a solid bi-functional catalyst comprising: (A) a support of an acidic nature consisting of a catalytically active porous solid, including silicon, aluminum, phosphorus and oxygen bonded to one another in such a way as to form a mixed amorphous solid characterized by an Si/Al atomic ratio of between 15 and 250, a P/Al ratio of at least 0.1, but lower than 5, a total pore volume ranging from 0.5 to 2.0 ml/g, with an average pore diameter ranging from 3 nm. to 40 nm, and a specific surface area ranging from 200 to 1000 M2/g; (B) at least one metal with a hydro-dehydrogenating activity selected from groups 6 to 10 of the periodic table of elements, dispersed on said support (A) in an amount of between 0.05 and 5% by weight with respect to the total weight of the catalyst.

23 Claims, 2 Drawing Sheets

Figure 1:
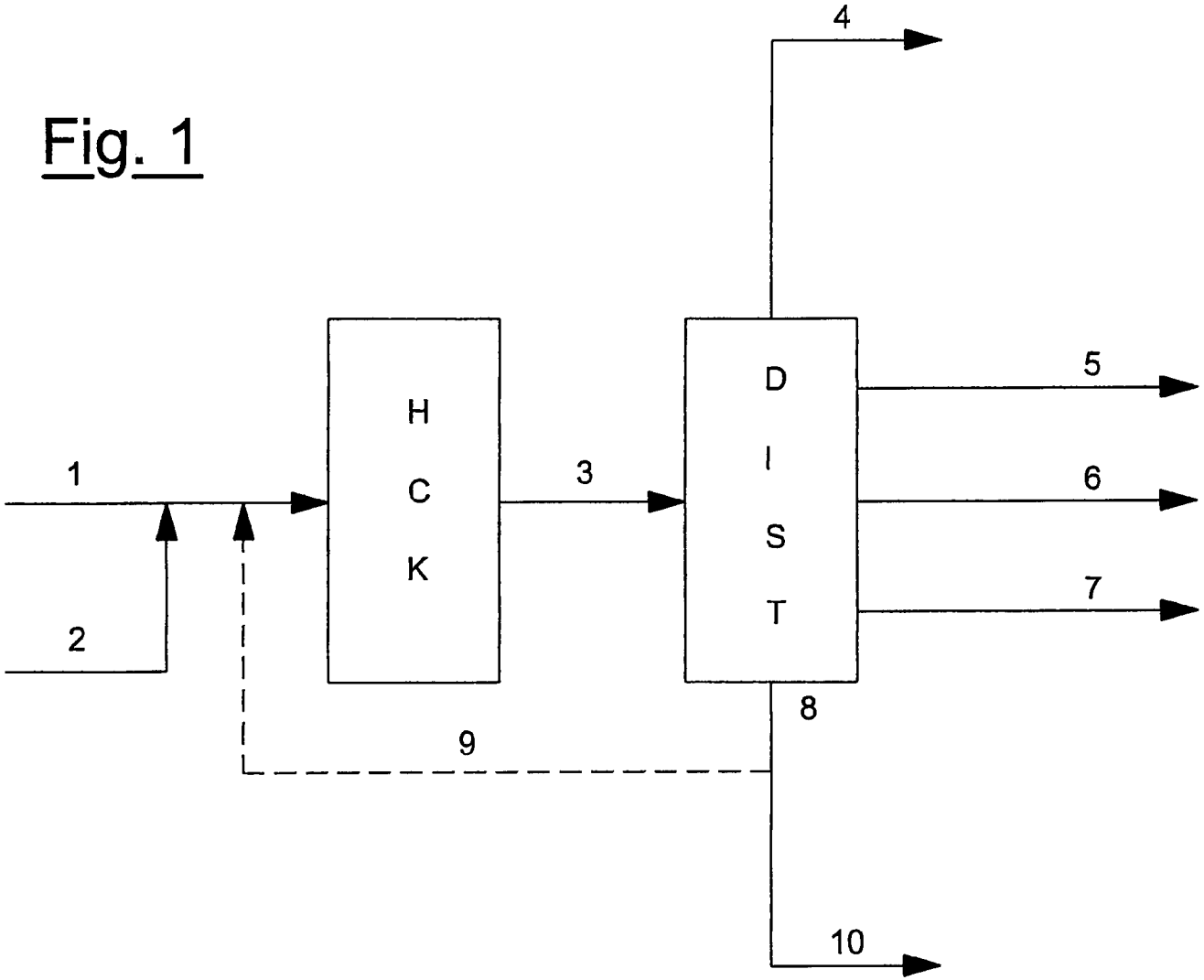

U.S. PATENT DOCUMENTS 4,125,566 A * 11/1978 Trin Dinh et al. ..... 208/65
4,440,631 A 4/1984 Togari et al.
4,499,202 A 2/1985 Arias et al.
4,832,819 A * 5/1989 Hamner ..... 208/27
4,943,672 A * 7/1990 Hamner et al. ..... 585/737
5,017,279 A * 5/1991 Oswald et al. ..... 208/67
5,037,528 A * 8/1991 Garwood et al. ..... 208/27
5,230,789 A * 7/1993 Chao et al. ..... 208/46
5,976,351 A * 11/1999 Apelian et al. ..... 208/27
6,320,088 B1 * 11/2001 Matsuno et al. ..... 585/21
6,475,960 B1 * 11/2002 Berlowitz et al. ..... 508/110
6,497,812 B1 * 12/2002 Schinski ..... 208/131
6,544,407 B1 4/2003 Calemma et al.
7,150,821 B2 * 12/2006 O'Rear et al. ..... 208/106
7,267,758 B2 * 9/2007 Benazzi et al. ..... 208/27
7,285,693 B2 * 10/2007 Clark ..... 585/1
7,300,565 B2 * 11/2007 Hoek ..... 208/89
2002/0045542 A1 4/2002 Benazzi et al.
2002/0193649 A1 * 12/2002 O'Rear et al. ..... 585/324
2003/0088137 A1 * 5/2003 Mart et al. ..... 585/734
2003/0088138 A1 * 5/2003 Mart et al. ..... 585/734
2003/0150777 A1 * 8/2003 Johnson et al. ..... 208/97
2004/0082728 A1 * 4/2004 Wu et al. ..... 525/338
2004/0097770 A1 * 5/2004 Dakka et al. ..... 585/467
2004/0206667 A1 10/2004 Calemma et al.

* cited by examiner

PROCESS FOR THE PREPARATION OF MIDDLE DISTILLATES AND LUBE BASES STARTING FROM SYNTHETIC HYDROCARBON FEEDSTOCKS

The present invention relates to a process for the preparation of middle distillates and lubricating bases starting from prevalently paraffinic hydrocarbon feedstocks of a synthetic origin.

More specifically, the present invention relates to a process for the contemporaneous production of middle distillates and lubricating bases, with a balanced yield, starting from feedstocks mainly consisting of n-paraffin mixtures, comprising at least one hydrocracking step in the presence of a particular bi-functional catalyst.

Mixtures of prevalently paraffinic hydrocarbons, including a considerable fraction with a high boiling point, are normally obtained as distillation residues in the refining processes of fuels of a petroleum origin. Other mainly paraffinic products are, for example, so-called "slack waxes" which are obtained as by-product of the production of lubricating bases through a solvent extraction process.

The production is also known, of hydrocarbon mixtures essentially consisting of n-paraffins, wherein a significant fraction has a boiling point of over 370° C., through catalytic synthesis, from mixtures of hydrogen and carbon monoxide (synthesis gas), in so-called Fischer-Tropsch processes, from the name of the inventors of the first synthesis of this type in the thirties'.

It is known that the Fischer-Tropsch (FT) synthesis leads to the formation of products consisting of n-paraffins (>90%), in addition to lower percentages of alcohols and olefins, characterized by a wide range of molecular weights. These products are normally in solid or semi-solid (waxes) form at room temperature. A characteristic of the FT process is that it is impossible to synthesize a product with a narrow molecular weight distribution. Moreover, due to the chemical nature of the products, the low temperature characteristics of the middle distillate cut are very poor.

For the above reasons, it is necessary to subject said hydrocarbon mixtures, especially FT waxes, to degradation and/or regradation treatment to obtain products of greater interest, such as fuels, lubricants, solvents and other derivatives having better properties. At present, an improvement in the above-mentioned aspects is obtained by subjecting the waxes to more or less complex processes for the reduction of the chain length in the presence of hydrogen (usually known by term "hydrocracking") and hydro-isomerization.

The kerosene and gas oil produced through the hydrocracking of FT waxes, have excellent characteristics both for specific requests as fuel and also due to their low environmental impact. The absence of heteroatoms, such as sulphur, and aromatic structures, leads to a drastic reduction in polluting emissions such as particulate and $NO_x$.

At the same time, other hydrocracking and/or isomerization catalysts have been developed for the production of lubricating oils, having optimum performances in terms of composition and isomerization degree of the lubricating bases obtained starting from n-paraffin feedstocks. These hydrocracking processes are carried out in the presence of a bi-functional catalyst, containing a metal with a hydro-dehydrogenating activity supported on an inorganic solid normally consisting of an oxide or silicate with acidic characteristics.

Hydrocracking catalysts typically include metals of groups 6 to 10 of the periodic table of elements (in the form approved by IUPAC and published by CRC Press Inc. in 1989, to which reference will be made hereunder), especially nickel, cobalt, molybdenum, tungsten or noble metals such as palladium or platinum. Whereas the former are more suitable for processing hydrocarbon mixtures having relatively high sulphur contents, noble metals are more active but are poisoned by sulphur and require a feedstock which is essentially without this.

Supports which can be used for the purpose are various type of zeolites (β, Y), X—$Al_2O_3$ (where X can be Cl or F), silico-aluminas, the latter being amorphous or with various crystallinity degrees, or mixtures of crystalline zeolites and amorphous oxides. A very wide examination of the different catalysts, the specific characteristics and different hydrocracking processes based on the same, can be found, among the many available in literature, in the publication of J. Scherzer and A. J. Gruia "Hydrocracking Science and Technology", Marcel Dekker, Inc. Editor (1996).

It is also well known that the above-mentioned isomerization and hydrocracking processes are carried out under conditions wherein the conversion per passage of the high boiling fraction is rarely over 90% and is normally maintained at below 80%, especially to reduce the production of low value light fractions. The non-converted fraction can be recycled to the hydrocracking, or is separated and used for the production of lubricating bases. In this case, it is necessary for the high-boiling residue to be subjected to further treatment (isomerization and/or dewaxing) whose purpose is to transform or separate the waxy fraction present therein.

One of the most relevant problems in the hydrocracking process of linear paraffin mixtures, consists of the difficulty of contemporaneously obtaining, from the same process, middle distillates with good low temperature characteristics and a 360+° C. fraction with suitable characteristics in terms of average molecular weight and isomerization degree, for the production of bases for lubricant oils. If a 150+° C. cut is subjected to hydrocracking using the catalytic systems currently in use and the reaction is carried out so as to obtain middle distillates having good low temperature characteristics, the 360+° C. residue has too low a molecular weight and consequently the obtained lubricating base exhibit a low viscosity. When the reaction, on the contrary, is carried out so as to obtain a 360+ cut with a sufficiently high molecular weight, the yields of lubricating base are low, due to the presence of a still high quantity of linear paraffins, which makes it necessary a subsequent dewaxing step and, in addition, the cold properties of the middle distillates are not satisfactory.

No solution seems to have been found as yet for the above overall problems with respect to the processes and catalysts of the known art. Even though the use, as catalyst support, of certain particular amorphous micro-mesoporous silico-aluminas, as described in European patent application EP-A 1,101,813, is capable of providing an excellent equilibrium between gas oil and kerosene in the middle distillate fraction, it apparently does not also allow a fraction of lubricating base to be produced with optimal characteristics which enable it to be adopted without any further specific treatment.

It has now been surprisingly found that certain amorphous silico-aluminas with a low aluminum content, containing certain quantities of phosphorus, bonded to the oxide matrix, are advantageously suitable as active support in combination with one or more metals with a hydro-dehydrogenating function, for the preparation of a catalyst for refining processes such as the hydro-treatment of hydrocarbons for the production of fuels and lubricating bases.

A first object of the present invention therefore relates to a process for the preparation of middle distillates and lubricating bases starting from a mix of mainly paraffinic hydrocarbons obtained by means of a synthesis process from hydrogen and carbon monoxide, consisting for at least 30%, preferably at least 50%, of a high-boiling fraction with a distillation temperature higher than 360° C., comprising:

(i) at least one hydrocracking step, wherein said hydrocarbon mix is reacted with hydrogen at a temperature of between 200 and 450° C. and a pressure of between 0.5 and 15 MPa, in the presence of a catalyst, for a time sufficient for converting at least 40%, preferably from 60 to 95%, of said high-boiling mix, into a fraction of hydrocarbons which can be distilled at temperatures lower than 360° C.;

(ii) at least one distillation step of the product of step (i) for separating at least a fraction of middle distillate and at least one residue with a boiling point higher than 340° C., used, at least partially, for the preparation of a lubricating base;

characterized in that the catalyst in said hydrocracking step (i), includes a solid supported catalyst comprising:

(A) a support of an acidic nature consisting of a catalytically active porous solid, including silicon, aluminum, phosphorus and oxygen bonded to one another in such a way as to form a mixed amorphous solid forming a single phase, characterized by an Si/Al atomic ratio of between 15 and 250, a P/Al ratio of at least 0.1, but lower than 5, preferably of between 0.3 and 3.5, a total pore volume ranging from 0.5 to 2.0 ml/g, an average pore diameter ranging from 3 nm to 40 nm, and a specific surface area ranging from 200 to 1000 $m^2/g$, preferably between 300 and 900 $m^2/g$;

(B) at least one metal with a hydro-dehydrogenating activity selected from groups 6 to 10 of the periodic table of elements, dispersed on said support (A) in an amount of between 0.05 and 5% by weight with respect to the total weight of the catalyst.

Other objects of the present invention will appear evident from the following description and claims.

The meaning of some of the terms used herein is defined hereunder, for the purpose of clarifying the description and claims of the present patent application and defining its scope:

the term amorphous as used herein with reference to the porous support of the catalyst of the present invention and its compositions and uses, indicates a substantial absence of low angle X-ray scattering signals, according to the usual measuring technique described further on;

"distillation temperature" referring to a hydrocarbon mix, indicates, when not otherwise specified, the head temperature or temperature range of a typical distillation column wherein said mixture is collected, at normal pressure (0.1009 MPa);

the range definitions always include the extremes, when not otherwise specified, nevertheless, the term "range included" within two extremes, refers to any range between said extremes;

the term "hydrocracking" is used herein with the general meaning of the high temperature catalytic treatment of a hydrocarbon mix, preferably including a fraction with a boiling point higher than 350° C., in the presence of hydrogen, obtaining a mixture with a lower boiling point; the hydrocracking treatment normally also includes so-called hydro-isomerization treatment, in so far as an isomerized product is obtained, having a boiling temperature lower than that of the feeding mix;

the terms "kerosene" and "gas oil" as hereinafter used, refer to the two hydrocarbon fractions forming the so-called middle distillate, with a distillation temperature of between 140 and 280° C. and between 240 and 380° C., respectively.

In its most general form, the acidic support (A) of the catalyst, according to the present invention, essentially comprises an amorphous homogeneous phase of mixed silicon, aluminum and phosphorus oxide, wherein the phosphorus is in the maximum oxidation state (+5) and is commonly bonded to the matrix of the other oxides by means of P—O—Al bonds, as determined by means of $^{27}$Al—NMR and $^{31}$P-NMR spectroscopic analysis. It has an extremely high surface area (determined by the BET method), preferably ranging from 300 to 900 $m^2/g$, more preferably from 400 to 800 $m^2/g$, and a pore size within the range of mesopores, preferably with an average diameter (determined by means of the DFT method) ranging from 5 to 30 nm, more preferably from 6 to 25 nm. The porosity (total pore volume as ml/g) is extremely high and can be regulated, within certain limits, through the times, temperatures and other operating parameters during the gel formation in the preparation process of said support. The porosity of the amorphous support preferably ranges from 0.7 to 1.7 ml/g.

From a morphological point of view, the catalytically active amorphous solid of the present invention comprises a non-ordered network of pores with an essentially monomodal size distribution within a relative wide range. The difference between 10% and 90% of the pore dimensions in the distribution curve is preferably within a range of diameters from 2 to 40 nm, preferably from 5 to 30 nm. The oxides forming the matrix are in turn arranged disorderly in a three-dimensional polymeric lattice, without forming crystalline structures detectable with X-rays.

Said acidic amorphous support prevalently consists of silicon oxide and is characterized by the presence of certain quantities of Al and P homogeneously bonded and distributed in the oxide matrix, so that the P/Al ratio is lower than 5 and at least equal to 0.1. For P/Al ratio values of 5 or higher, a substantial collapse of the porous structure is observed, with a considerable decrease in the catalytic and support properties; for P/Al values lower than 0.1, no substantial progress was observed with respect to a traditional amorphous silica and alumina matrix having an analogous composition. More advantageous results were obtained when the P/Al ratio ranges from 0.3 to 3.5, and particularly within the range of 0.5 to 2.5.

One of the essential characteristics of the catalyst of the present invention is the selection in the support (A) of the aluminum content within a narrow and quantitatively limited range, which in turn determines the phosphorus content range. The Si/Al atomic ratio preferably ranges from 20 to 200, more preferably from 25 to 150.

Said amorphous support can also comprise, when necessary, smaller quantities of other components, in a mix or dispersed in the oxide matrix, in particular other metal compounds, especially oxides, different from those forming the component (B), suitable for giving particular characteristics or catalytic functions. Said additional components do not normally form more then 20% by weight of the amorphous solid, preferably up to 10% by weight. In particular, the catalyst support according to the present invention can contain, in a mixture, phosphorus oxides or phosphates not bonded to the matrix of amorphous silica and alumina. Other oxides which can be present are those of certain transition metals, particularly selected from Ti, Zr, V, Zn, Ga and Sn, whereas alkaline or alkaline earth metals are preferably absent or only present in traces. These metals can advantageously provide the amorphous solid of the present invention with improved mechanical properties and further catalytic functions, such as oxidation, which are requested for certain industrial processes.

Said amorphous support can be prepared by adapting various typical sol-gel methods for the preparation of micro- or meso-porous amorphous silico-alumina, by the addition of a suitable quantity of an appropriate phosphorus compound in any of the steps preceding calcination, preferably before or during the formation of gel. The phosphorus compound is preferably selected form organic or inorganic oxygenated compounds, capable of forming phosphorus oxide or a phosphate group after the oxidizing thermal treatment suitable for drying and calcining the gel, more preferably such as to avoid introducing traces of undesirable metals in the matrix of porous oxide obtained after calcination.

Sol-gel methods for the preparation of amorphous silico-aluminas which can be adapted for the purpose, are described, for example, in European patent applications EPA 160,145, EP-A 340,868 and EP-A 659,478 or in the publication "Journal of Catalysis, Vol. 60 (1969), pages 156-166, whose contents are incorporated herein as reference, without limiting the scope of the present invention to said methods.

An advantageous preparation method of said amorphous active support (A), includes, in a first step, the preparation of a mixture comprising a tetra-alkyl ammonium hydroxide, an aluminum compound and a silicon compound, which can be hydrolyzed to the corresponding oxide hydrates, an oxygenated compound of phosphorus and a sufficient quantity of water to dissolve and hydrolyze said compounds, wherein said tetra-alkyl ammonium hydroxide comprises from 1 to 10 carbon atoms in each alkyl residue, said hydrolysable aluminum compound is preferably an aluminum trialkoxide comprising from 1 to 10 carbon atoms in each alkoxide residue, said hydrolysable silicon compound is a silicate of at least one hydrocarbon residue, preferably a tetra-alkyl ortho-silicate, comprising 1 to 10 carbon atoms for each alkyl residue, and said oxygenated phosphorus compound is a salt or phosphate or phosphonic ester or the corresponding acid, preferably an ammonium salt or a phosphate or phosphonic ester in which each alkyl residue comprises from 1 to 10 carbon atoms.

The aqueous mixture of the above compounds is then hydrolyzed and gelled in a second step, by heating in an alkaline environment, preferably at a pH greater than 10, either by refluxing in a closed vessel, at the normal boiling point or higher, or in an open vessel below this temperature, so that there is essentially no exchange of material with the outside. The gel thus produced is subsequently subjected to a third drying and calcination step.

The aqueous mixture in said first step can be made up in water or in a mixture of water and a soluble oxygenated organic compound, preferably an alcohol having from 1 to 10 carbon atoms, in a quantity of up to 1/1 in moles with respect to the water. More preferably, the oxygenated compound is an alcohol having from 2 to 5 carbon atoms. During the hydrolysis, a further quantity of alcohol is released into the aqueous solvent.

The tetra-alkyl ammonium hydroxide which can be used for the purposes of the present invention is selected, for example, from tetra-ethyl, propyl-, isopropyl-, butyl-, isobutyl-, terbutyl, and pentyl-ammonium hydroxide and among these tetra-propyl-, tetra-isopropyl- and tetra-butyl ammonium hydroxide are preferred. The aluminum trialkoxide is selected, for example, from aluminum triethoxide, propoxide, iso-propoxide, butoxide, iso-butoxide and terbutoxide and among these aluminum tri-propoxide and triiso-propoxide are preferred. The tetra-alkyl orthosilicate is selected for example from tetra-methyl-, tetra-ethyl-, propyl-, isopropyl-, butyl-, isobutyl-, terbutyl-, and pentyl-orthosilicate and among these tetra-ethyl orthosilicate is preferred.

The oxygenated phosphorus compound is preferably selected from organic or inorganic compounds soluble in the reaction mixture, comprising a phosphate, phosphite or phosphonic group. According to an embodiment of the present invention, the phosphorus compound can also be formed in situ in the reaction mixture, or it can be added to said mixture in the form of a solution in a suitable solvent, preferably an alcohol or water. Typical phosphorus compounds suitable for the purpose are, for example, phosphoric acid, phosphorous acid, ammonium phosphate, quaternary ammonium phosphates with organic amines having from 1 to 5 carbon atoms for each residue bonded to the nitrogen atom, organic phosphites and phosphates of alcohols having from 1 to 10, preferably from 1 to 5 carbon atoms, acid phosphates of ammonium or quaternary ammonium, alkyl-phosphonates or alkyl-phosphinates of alkyl residues having from 1 to 10, preferably from 1 to 5, carbon atoms.

Particularly preferred phosphorus compounds are ammonium phosphate, acidic ammonium phosphate and the corresponding quaternary phosphates with organic amines having from 1 to 4 carbon atoms per residue, especially in the form of a solution prepared by the addition in water of phosphoric acid and the corresponding stoichiometric quantity of ammonia or amine.

In the preparation of the aqueous mixture of said first step, the order of addition of the various reagents is not particularly critical. The phosphorus compound can be added or formed in situ initially, together with the addition of the tetra-alkyl ammonium hydroxide, by regulating the quantities so as to respect the desired final ratios between atoms and components, or it can be added after the introduction of the Si and Al compounds. The mixture is prepared at room temperature or a slightly higher value, preferably between 30 and 80° C. Although the thus formed mixture preferably consists of a limpid solution, certain compounds, such as aluminum alkoxide for example, can remain partially undissolved, but are completely dissolved in the heating step and hydrolysis of the subsequent step. In certain cases, a time of up to five hours under stirring may be necessary for obtaining a solution.

In a preferred embodiment of the process for the preparation of said amorphous solid according to the present invention, an aqueous solution is first prepared, containing the tetra-alkyl ammonium hydroxide and the aluminum trialkoxide, operating at a temperature which is sufficient to guarantee an effective dissolution of the aluminum compound, preferably from 40 to 80° C. The tetra-alkyl orthosilicate is added to said aqueous solution. If necessary, the pH is regulated to a value greater than 10, preferably between 11 and 12. This mixture is brought to a temperature which is suitable for triggering the hydrolysis reaction. Said temperature is in relation to the composition of the reaction mixture (normally from 60 to 120° C.). The hydrolysis reaction is exothermic and therefore guarantees self-maintenance, once the reaction has been activated. The quantities of constituents of the mixture are selected so as to respect the atomic ratios between the elements to be obtained in the catalytically active solid at the end of the preparation; the following atomic or molar ratios are conveniently used: Si/Al from 10/1 to 250/1, (tetra-alkyl ammonium hydroxide)/Si from 0.05/1 to 0.2/1, $H_2O/SiO_2$ from 5/1 to 40/1, P/Al from 0.1 to 5.0. The preferred values for these ratios are: Si/Al from 30/1 to 150/1, (tetra-alkyl ammonium hydroxide)/Si from 0.05/1 to 0.2/1, P/Al from 0.5 to 3.5 and $H_2O/SiO_2$ from 10/1 to 25/1.

The hydrolysis of the reagents and their gelation are preferably effected operating at a temperature equal to or higher than the boiling temperature, at atmospheric pressure, of any alcohol which develops as by-product of said hydrolysis reaction, without eliminating or substantially eliminating said alcohols from the reaction environment. The hydrolysis and gelation temperature is therefore critical, and is conveniently maintained at values higher than about 65° C. up to about 110° C. Furthermore, in order to maintain the alcohol which was developed, within the reaction environment, it is possible to operate in an autoclave at the autogenous pressure of the system at the preselected temperature (normally in the order of 0.11-0.15 MPa absolute), or at atmospheric pressure in a reactor equipped with a reflux condenser.

According to a particular embodiment of the process, the hydrolysis and gelation are carried out in the presence of a quantity of alcohol higher than that which develops as by-product. For this purpose, a free alcohol, preferably ethanol, is added to the reaction mixture in a quantity up to a maximum molar ratio between alcohol added and $SiO_2$ of 8/1.

The time necessary for completing the hydrolysis and gelation, under the conditions indicated above, usually varies from 10 minutes to 3 hours and is preferably in the order of 1-2 hours.

It has also been found useful to subject the gel thus formed to aging, by maintaining the reaction mixture in the presence of the alcohol and at room temperature, for a period in the order of 1-24 hours.

The alcohol is finally removed from the gel which is dried, operating according to the known art, so as to avoid fracturing of the solid and substantially maintaining the pore structure unaltered. Reduced pressure is normally applied, generally from 1 to 20 kPa and preferably from 3 to 6 kPa, together with a temperature ranging from 50 to. 120° C., preferably from 100 to 110° C. According to a preferred method, the drying is effected operating with a gradient (or profile) of (increasing) temperatures and (decreasing) pressures within the above ranges to allow the gradual evaporation of the solvent. The dried gel is finally subjected to calcination in an oxidizing atmosphere (normally in air), at a temperature ranging from 500 to 700° C. for a period of 4-20 hours and preferably from 500-600° C. for 6-10 hours, also in this case preferably operating with a suitable temperature gradient.

The amorphous support based on silicon, aluminum and phosphorus, thus obtained, has a composition corresponding to that of the reagents used, considering that the reaction yields are practically complete. Therefore, the Si/Al atomic ratio varies from 15/1 to 250/1 in the preferred case, the most preferred values ranging from 20/1 to 150/1 and specifically in the order of 100/1. This support results substantially amorphous, when subjected to analysis by means of powder X-ray diffraction, it has a surface area of at least 200 $m^2/g$ and normally within the range of 300-900 $m^2/g$ and a pore volume of between 0.5-2.0 $cm^3/g$, preferably of between 0.6 and 1.8 $cm^3/g$.

According to what is known in the art with respect to heterogeneous catalysis, the above-mentioned amorphous support (A) of the present invention catalyst, can be advantageously mixed and processes with other inert compounds such as, for example, pseudo-bohemite which, after calcination, becomes γ-alumina, suitable for providing enhanced mechanical and morphological properties, desirable for industrial use, especially for improving the consistency and stability of the granules in the catalytic beds, thus increasing the durability, and for reducing the amounts of catalyst residues in the product obtained. The incorporation of said inert component, commonly called "binder", into the catalyst support, can be effected both by addition to the amorphous support (A) in the form of gel, or after drying or calcination, and by addition to the preformed catalyst, including the metal (B). The addition to the support is, in any case, preferred for the purposes of the present invention.

Therefore, in accordance with a particular aspect of the present invention, said support (A) can, when necessary, form a composition mixed with a suitable quantity of a binder consisting of an inert inorganic solid, generally added for the purpose of improving the mechanical properties, such as for example, silica, alumina, clay, titanium oxide ($TiO_2$) or zirconium oxide ($ZrO_2$), boron oxide ($B_2O_3$) or mixtures thereof. It is generally preferably, in fact, for its industrial applications, for said solid to be used in granular rather than powder form, and for it to have a relatively narrow particle-size distribution. Furthermore, it is preferably endowed with sufficient mechanical resistance to compression and impact to avoid its progressive breakage during use, due to the fluid-dynamic and vibrational stress effected by the process fluids.

Possible binders can be all those which are known to be suitable for the purpose, both natural and synthetic, preferably silica and alumina, and particularly alumina in all its known forms, for example gamma-alumina.

Said reinforced amorphous solid according to the present invention can be obtained by means of any of the mixing, extrusion and granulation (pelletizing) methods of solid materials in a mixture, for example, according to the methods described in European patent applications EP-A 550,922 and EP-A 665,055, the latter preferred, both filed by the Applicant, whose contents are incorporated herein as reference.

In particular, according to a preferred method, the gel obtained from the hydrolysis and gelation of the aqueous mixture of Al alkoxide, tetra-alkyl silicate and oxygenated phosphorus compound, prepared as described above, is mixed, before the calcination step (iii), with the desired quantity of inorganic binder, based on the dry weight, normally with a weight ratio between binder and gel (humid) within the range of 0.05 to 0.5. A plasticizer, selected from those generally known to be suitable for the purpose, is also preferably added, for example methyl cellulose, stearine, glycerol, more preferably methyl cellulose, to favour the formation of a homogeneous mixture which can be easily processed. This plasticizer is generally added in a quantity ranging from 5 to 20 g per 100 g of binder.

A suitable acidifying compound, selected from organic acids, such as acetic acid or acetic anhydride, oxalic acid, or inorganic acids, such as hydrochloric acid or phosphoric acid, is then added in a quantity preferably ranging from 0.5 to 8 g per 100 g of binder. Acetic acid is particularly preferred.

The mixture thus obtained is homogenized by mixing and heating to a temperature ranging from 40 to 90° C., with partial evaporation of the solvent, until a paste is obtained, which is then extruded using suitable equipment. The extruded product is cut into cylindrical granules, preferably with a size of 2-10 mm in length and 0.5-4.0 mm in diameter. According to an alternative embodiment, the above homogeneous paste can also be dried in a suitable granulator, in order to obtain granules having the desired dimensions.

The granules thus obtained are subjected to progressive heating to eliminate the residual quantities of solvent and finally calcined in an oxidizing atmosphere, generally in a stream of air, at a temperature ranging from 400 to 600° C., for 4-20, preferably 6-12 hours.

A granular acid solid is thus obtained, having the desired catalytic and mechanical properties, containing a quantity of 1 to 70% by weight, preferably from 20 to 50% by weight, of said inert inorganic binder, the remaining percentage consisting of amorphous support (A), as previously defined. The granular solid is preferably in the form of pellets having a size of about 2-5 mm in diameter and 2-10 mm in length.

Both the porosity and surface area of the extruded product normally have average values with respect to the values of the single components in the mixture, according to linear composition rules.

The catalytically active amorphous support of the present invention, both as such and mixed with other inert materials, has acidic characteristics. It is distinguished by the advantageous combination of a pore diameter and surface area which are both relatively high. According to the studies carried out by the Owner, this combination favours a particularly desirable catalysis selectivity and orientation, especially in hydrotreatment processes of hydrocarbons, and paraffins in particular, for example in the transformation processes of hydrocarbon fractions, such as hydrocracking, hydro-isomerization and dewaxing, with improved activity and selectivity with respect to the traditional amorphous silica-alumina gel, particularly when a range of products, from kerosene to the lubricating bases, is to be obtained, by reducing as much as possible the use of dewaxing steps, separated or subsequent to the hydrocracking step.

According to the present invention, the metal of component (B) of the catalyst is selected from those having a hydrodehydrogenating activity, in the presence of hydrogen/hydrocarbon mixtures, under the suitable process conditions. Metals especially suitable for the purpose are those selected from groups 6 to 10 of the periodic table. Combinations of nickel with molybdenum, tungsten and cobalt as well as the noble metals platinum or palladium, or mixtures thereof, and preferably platinum and palladium, more preferably platinum, are of particular interest.

Combinations of metals of group 6, especially tungsten or molybdenum, with the metal of group 9, especially nickel or cobalt, are particularly suitable, as is known for other catalysts of the art suitable for processing hydrocarbons, when the mixtures contain non-negligible amounts of sulphur.

According to the present invention, said catalyst can be prepared through a method which includes contact, under suitable conditions, of said active support (A) with a suitable compound of said metal (B). The metal is conveniently distributed as uniformly as possible on the porous surface of the support, in order to maximize the catalytic surface which is effectively active. For this purpose, various known methods can be used, such as those described for example in European patent application EP-A 582,347, whose contents are incorporated herein as reference. In particular, according to the impregnation method, the amorphous support (A), as such or preferably extruded, is put in contact with an aqueous and/or alcoholic solution of a soluble compound of the desired metal for a period sufficient to provide a homogeneous distribution of the metal in the solid. This normally requires from a few minutes to several hours, preferably under stirring. Soluble salts suitable for the purpose are, for example, $H_2PtF_6$, $H_2PtCl_6$, $[Pt(NH_3)_4]Cl_2$, $[Pt(NH_3)_4]$ $(OH)_2$ and analogous salts of palladium; mixtures of salts also of different metals are equally included in the scope of the invention. The minimum quantity of aqueous liquid (normally water or an aqueous mixture with a second inert liquid or with an acid in a quantity lower than 50% by weight) is conveniently used, which is sufficient to dissolve the salt and uniformly impregnate said support, preferably with a weight ratio solution/solid ranging from 1 to 3. The quantity of metal is selected on the basis of its concentration which is to be obtained in the catalyst, as the whole metal is fixed on the support.

At the end of the impregnation, the solution is evaporated and the solid obtained is dried and calcined in an inert or reducing atmosphere, under analogous temperature and time conditions as those cited above for the calcination of the amorphous solid or extruded product.

An alternative method to impregnation is the ion exchange system. According to the latter, the amorphous silica/alumina/phosphate solid is put in contact with an aqueous solution of a salt of the metal as in the previous case, but the deposition takes place by exchange under conditions made basic (pH between 8.5 and 11) by the addition of a sufficient quantity of an alkaline compound, normally an ammonium hydroxide. The suspended solid is then separated from the liquid by means of filtration or decanting and dried and calcined as specified above.

According to another alternative, the salt of the metal (B) can be included in the catalytically active support in the gel preparation step, for example before hydrolysis for the formation of humid gel, or before its calcination.

At the end, a catalyst is obtained for the hydrotreating of hydrocarbons, in accordance with the present invention, wherein metal M is uniformly dispersed in amounts ranging from 0.05 to 5% by weight, preferably from 0.1 to 2%, more preferably from 0.2 to 1% by weight, with respect to the total weight of the catalyst, especially when the metal is selected from Pt and Pd.

A typical method for the preparation of a catalyst in extruded form, comprising the active solid of the present invention as support, includes the following steps:

(a) solution A is prepared of the hydrolysable components and ammonium phosphate as described above, in suitable quantities for obtaining the desired final composition;

(b) the above solution is heated to 60-70° C. to cause its hydrolysis and gelation and to obtain a gel mixture with a viscosity ranging from 0.01 to 100 Pa*sec;

(c) a binder, belonging to the group of bohemites or pseudobohemites, is first added to the gel mixture, in a weight ratio with the same ranging from 0.05 to 0.5, followed by methyl cellulose as plasticizer in a quantity ranging from 10 to 20 g per 100 g of said binder; and finally a mineral or organic acid in a quantity ranging from 0.5 to 8.0 g per 100 g of said binder;

(d) the mixture obtained under point (c) is heated under mixing to a temperature ranging from 400 to 90° C. until a homogeneous paste is obtained, which is subjected to extrusion and granulation;

(e) the extruded product obtained under (d) is dried and calcined in an oxidizing atmosphere.

In this way, a granular solid support is obtained, with an acidic catalytic activity, containing a quantity ranging from 30 to 70% by weight of inert inorganic binder, the remainder consisting of the active porous solid of silicon/aluminum/phosphorus oxide, having essentially the same characteristics of porosity, surface extension and structure as described above for the same porous solid without binder. The granules are conveniently in the form of pellets having a size of about 2-5 mm in diameter and 2-10 mm in length.

The supporting step of the noble metal on the active granular solid is effected with the same procedure specified above.

Before use, the catalyst thus obtained is normally subjected to activation in a reducing atmosphere, according to one of the known methods suitable for the purpose, which can also be carried out directly in the reactor preselected for the hydrocracking reaction. A typical method uses the procedure described hereunder:

1) 2 hours at room temperature in a nitrogen stream;
2) 2 hours at 50° C. in a stream of hydrogen;
3) heating to 310-360° C. with an increase of 3° C./min in a stream of hydrogen;
4) constant temperature of 310-360° C. for 3 hours in a stream of hydrogen and cooling to 200° C.

During the activation, the pressure in the reactor is maintained between 3.0 and 8,1 MPa (30 to 80 atms).

Using the catalyst as described above in the hydrocarbon hydrocracking process of the present invention, it was surprisingly possible to obtain, with an excellent yield, the conversion of heavy paraffin fractions (waxes with a boiling point over 360+° C.) into middle distillates having good properties at low temperatures, and contemporaneously produce a residue with a high content, preferably higher than 70% by weight, of lubricating base having a high viscosity index and a suitable viscosity especially for use for motor-vehicle engines.

The hydrocarbon mix fed to the process according to the present invention, preferably consists of substantially linear synthetic paraffins, and can include a middle distillate fraction in addition to the fraction of high-boiling hydrocarbons (liquid and/or solid at room temperature). According to the process of the present invention, the amount of low-boiling fraction (<150° C., naphtha and volatile matters) produced, even in the presence of an amount of middle distillate higher than 50% in the feeding, is normally very limited, preferably lower than 15%, also with conversion per passage of between 80 and 90%.

The hydrocarbon mix suitable for feeding the process according to the present invention, can generally comprise up to 20%, preferably up to 10% by weight, of an organic non-paraffinic fraction. In particular, it has a reduced sulphur content, preferably lower than 5,000 ppm by weight of S, better if lower than 1,000 ppm or even non-traceable and can contain oxygenated organic compounds, such as alcohols, ethers or carboxylic acids, preferably in an amount lower than 5% by weight.

For an optimum embodiment of the process according to the present invention, said feeding mix of the hydrocracking step preferably consists, for at least 80%, of linear paraffins having from 5 to 80, preferably from 15 to 70, even more preferably from 20 to 65 carbon atoms, and an initial boiling point ranging between 45 and 675° C. (by extrapolation), preferably between 170 and 630° C. (by extrapolation).

According to a particular aspect of the present invention, said feeding to step (i) includes at least 30% by weight, preferably from 40 to 80% by weight of a high-boiling fraction distillable at a temperature≧360° C., and up to 80%, preferably from 20 to 60% by weight of a hydrocarbon fraction corresponding to the s-called "middle distillate", divided into the traditional kerosene and gas oil cuts, previously defined.

According to a different preferred aspect of the present invention, the feeding mix has a boiling point of at least 260° C., more preferably of at least 350° C. It has been found that, under these conditions, especially if the feed consists of substantially linear hydrocarbons, it is possible to produce both middle distillates and lubricating bases having optimum characteristics, and in the desired relative amounts, within the limits imposed by the initial feeding composition.

Processes in which the feed is different from the preferred ones mentioned above, are not excluded from the present invention. The prevalently linear hydrocarbon mixtures having distillation intervals equal to or higher than 260° C., are solid or semisolid at room temperature and for this reason they are normally called waxes.

Typical examples of suitable feeds are mixtures of synthetic hydrocarbons prepared through processes using mixtures of hydrogen and carbon monoxide (so-called synthesis gas) as feed, for example those obtained by means of the Fischer-Tropsch process.

The latter are particularly characterized by the absence of sulphur and preferably consist, for over 70% by weight, of linear paraffins having more than 15 carbon atoms and a boiling point higher than 260° C. As already mentioned, these mixtures are frequently solid or semi-solid at room temperature and for this reason are called waxes. Not all Fischer-Tropsch processes provide high-boiling linear paraffin mixtures. According to the conditions and catalyst used, the Fischer-Tropsch process can produce mixtures within several distillation temperature ranges, even quite low, if desired. It has been found however that it is more convenient to run the synthesis process so as to obtain prevalently high-boiling mixtures or waxes, which can be subsequently suitably degraded and fractioned into the desired distillation cuts. It is also well known that the Fischer-Tropsch synthesis provides by-products mainly consisting of olefins and oxygenated products. The latter are essentially alcohols and their concentration is lower than 10% by weight with respect to the total, if a cobalt synthesis catalyst is used.

The hydrocracking step of the process according to the present invention, can be generally carried out at the temperatures and pressures of traditional processes of this type, known in the art. Temperatures are normally selected between 250 and 450° C., preferably from 300 to 370° C., whereas the pressure is selected from 0.5 to 15 MPa, preferably between 1 and 10 MPa, also including the hydrogen pressure.

Hydrogen is used in a sufficient amount for effecting the desired conversion under the selected conditions. The mass ratio between hydrogen and hydrocarbons in the feeding (and consequent relative pressure of the same) can be easily selected by technical experts, depending on the other essential parameters of the process, such as the space velocity, the contact time, the catalyst activity and temperature, so to achieve the desired conversion degree. Initial (hydrogen)/(hydrocarbons) mass ratios of between 0.03 and 0.2 are normally considered to be satisfactory for carrying out the process, these values not being, however, limitative of the present invention. Under these conditions, only a small part of the hydrogen initially introduced is consumed, the remaining part can be easily separated and recycled using the common equipment suitable for this purpose. Normally, the use of essentially pure hydrogen, which is commercially available at low cost, is preferred, whereas in the most general case the use of mixtures of hydrogen with inert gases such as, for example, nitrogen, is not excluded.

The space velocity WHSV (defined as maximum flow rate as g/h, divided by the weight of the catalysts in grams), or the contact time (defined as the reciprocal of the space velocity: 1/WHSV), of the reagents under the conditions of the hydrocracking reaction, are generally selected as a function of the characteristics of the reactor and of the process parameters, so as to obtain the desired conversion degree. It is important for the contact time to be selected so that the $\alpha$ conversion degree—calculated as a mass of the 360+° C. fraction in the feedstock, minus the mass of the 360+° C. fraction in the products, divided by the mass of the 360+° C. fraction in the charge $[\alpha=(360+_{inlet}-360+_{outlet})/(360+_{inlet})]$–is maintained within the values over which significant undesired reactions take place, which jeopardize the production of the desired selectivity levels to middle distillate and lubricating base, for example by producing an excess of volatile products. Contact times are normally selected which allow a conversions of the high-boiling fraction (360+° C.) of between 60 and 90%, more preferably between 65 and 80%.

According to a typical embodiment of the process of the present invention, a mix of hydrocarbons having the above characteristics is preheated to a temperature of between 90 and 150° C. and fed in continuous, after its premixing with hydrogen, to a tubular fixed bed reactor operating in "down flow". The reactor is kept at a temperature of between 300 and 360° C. The reactor pressure is maintained at between 3 and 10 MPa. The catalyst is previously activated, for example according to the typical method mentioned above, and the hydrocracking process can be subsequently effected, normally after a catalyst stabilization step (about 60-100 hours).

The feeding preferably consists of a high-boiling mix coming from a synthesis process of the Fischer-Tropsch type, comprising 30 to 100% of waxes having a distillation point above 360° C. and up to 5% of oxygenated products. In the case of a feed containing alcohols, especially when these are in amounts higher than 5% by weight, technical experts can subject the same to a preliminary treatment, before the hydrocracking step of the process according to the present invention, in order to avoid the abovementioned drawbacks. This treatment can consist, for example, of a distillation step which removes a fraction with a cut having a temperature lower than 360° C., preferably between 260 and 360° C., in which, as is well known, the oxygenated products are normally concentrated, or subjecting the feeding mix to a selective hydrogenation step, in the presence of one of the known catalysts suitable for the purpose and under conditions which reduce conversion to products with lower boiling points, to the minimum, so as to eliminate the oxygenated groups (such as —OH, —COOH, ether, ketone or ester) and to produce non-oxygenated hydrocarbons and a small amount of water which can be possibly removed by evaporation or decanting.

According to said typical embodiment, the supported catalyst of the present invention is introduced into the reactor in granular form, preferably as a co-extruded product with a binder, for example γ-alumina, according to what is previously described. The metal with a hydro-dehydrogenating activity is preferably palladium or platinum, particularly platinum, especially in the case of a feed obtained by means of a Fischer-Tropsch synthesis. A fixed bed is conveniently used, on which the reagent mix is passed. The contact time is selected so as to have a conversion of between 60 and 80%. The space velocity preferably ranges from 0.4 to 8 $h^{-1}$, more preferably from 0.5 and 4 $h^{-1}$ The reaction mix at the outflow of the reactor is analyzed on line, by means of one of the known techniques, for example gas chromatography, and sent to said distillation/separation step (ii), in the upper part of which the middle distillate product is obtained, whereas the high-boiling residue, suitable for the production of lubricating bases, is obtained at the tail.

The light hydrocarbon fraction (gas and naphtha) having distillation temperatures lower than 150° C., which is normally formed in amounts lower than 10% by weight of the product obtained in step (ii), is removed by distillation from the head of the column and normally destined for different uses.

In accordance with the present invention, the high-boiling residue advantageously consists of an isomerized hydrocarbon mix having a high content, preferably over 80%, more preferably more than 90%, or even more preferably essentially consisting of a lubricating base with a high viscosity index, a low pour point, and a heat viscosity within a particularly desirable range. In particular, the lubricating base which can be obtained with the present process has the following preferred characteristics:

pour point: <−18° C.

viscosity at 100° C.: >4.0 cSt

Viscosity index (VI): >135

Noack: <15%.

When necessary, on the basis of market requests, an aliquot of said residue, preferably not more than 90%, more preferably not exceeding 50% by weight, can be advantageously recycled to the hydrocracking step to produce further middle distillate. In this case, it is also possible to improve the isomerization degree by suitably regulating the recycling, as in the normal technique of hydrocracking processes.

The operative conditions and equipment for running the process of the present invention can be easily set up and optimized by the average technical expert, on the basis of the present description and parameters herein defined. A particularly advantageous aspect of this process consists of the fact that it can be effected in most cases, and especially, by feeding a hydrocarbon mix obtained from a Fischer-Tropsch synthesis, essentially with a single reactive step (hydrocracking), normally combined with a single separation and recycling step, downstream of the reactor, thus obtaining high commercial value products, without necessarily resorting to other distillation and transformation combinations, with the exception of a possible mild dewaxing step on the high-boiling residue (for example 360+° C.) and/or separation of the 550° C. fraction from the above residue by means of vacuum distillation to isolate the desired lubricating base.

Several obvious variations of this process can be effected by technical experts in the filed, without involving any further inventive activity.

The solid catalyst described above can be used in the process according to the present invention, as such, after activation, in the hydrocracking step of the process according to the present invention. As mentioned above, however, said catalyst is preferably reinforced by the addition and mixing of a suitable amount of a binder consisting of an inert inorganic solid, capable of improving the mechanical properties.

According to a particular embodiment of the present invention, suitable for the treatment of hydrocarbon mixtures containing heteroatoms, in particular S, N or O, said process for the preparation of middle distillates and lubricating bases comprises, before the hydrocracking step, a hydrogenating treatment, under such conditions as to not produce any substantial variation in its average molecular weight, to obtain a substantially saturated hydrocarbon mix, without heteroatoms.

Mixtures of the above type can be commonly obtained by synthesis, such as, for example, paraffin mixtures produced by means of the Fischer-Tropsch synthesis, especially with cobalt-based catalysis. In particular, such a process variation is advantageously used for a substantially linear hydrocarbon mix, comprising up to 20%, preferably up to 10%, by weight of a non-paraffinic organic fraction, and it is characterized by a substantial absence of sulphur. In particular, its non-paraffinic content consists of oxygenated organic compounds, such as alcohols or ethers, usually in amounts of between 0.1 and 10%, preferably between 1.0 and 5% by weight.

The procedure for effecting said hydrogenating treatment is well known in the art, and does not represent a particular critical point for the process of the present invention, provided the degradation of the molecular weight of the treated fraction is practically negligible, in any case never over 15% of conversion to products included in the typical cut called naphtha, having a distillation temperature below 150° C. The hydrogenating step, in this case, must be such that not more than 15%, preferably not more than 10% of the constituents of the feeding mix having a distillation temperature of over 150° C., is converted to products having a lower distillation temperature.

Typical but non-limiting reaction conditions of the hydrogenating step are: temperature within the range of 280-380° C., hydrogen pressure between 0.5 and 10 MPa, space velocity (WHSV) ranging from 0.5 to 4 $h^{-1}$. The hydrogen/feedstock ratio is between 200 and 2000 Nlt/kg.

The hydrogenation reaction is normally effected in the presence of a suitable catalyst. The latter, according to the known art, preferably includes a metal of groups 6, 8, 9 or 10 of the periodic table of elements, dispersed on a support preferably consisting of an organic oxide, such as alumina, titania, silico-alumina, etc. Preferred hydrogenation catalysts are those based on nickel, platinum or palladium, supported on alumina, silico-alumina, fluorinated alumina, with a metal concentration which, according to the type, is between 0.1 and 70%, preferably from 0.5 to 10% by weight.

During the hydrogenation step, the reaction can be carried out at conditions and with a catalyst such as to obtain, when desired, a certain isomerization degree of the hydrocarbon mix, according to the known art.

The hydrocarbon mix thus obtained is preferably subjected to a separation step, through distillation, of gas and volatile products (<150° C.) possibly present, and, even more preferably, water and/or the other inorganic products deriving from the hydrogenation.

According to a further embodiment of the process according to the present invention, step (i) can be preceded by a preliminary separation step of a low-boiling fraction from the feeding mix. Said preliminary step can typically include a flash separation of a mix having a final boiling point of between 150 and 370° C., preferably between 260 and 360° C., which contains most of the oxygenated compounds possibly present in the case of a feeding consisting of a Fischer-Tropsch synthesis product. The low-boiling mix thus separated can be subsequently processed according to one of the known techniques for obtaining middle distillates and/or fractions suitable for the production of gasoline. For example, it can be subjected to a hydrogenation step of the type previously described, followed by an isomerization step in suitable equipment in the presence of a catalyst and under such conditions as to favour the isomerization reaction with respect to the cracking reaction, such as those described, for example, in European patent EP 908.231. The desired middle distillate fractions are separated from the product thus isomerized, by means of a normal fractionated distillation column.

The high-boiling fraction obtained in this preliminary step, forms the feeding of step (i) and is treated according to the process of the present invention for the production of high quality middle distillates and lubricating bases. According to a preferred aspect, moreover, the subsequent step (ii) consists of a flash distillation for the separation of a low-boiling fraction comprising the volatile products (150−° C.) and middle distillate, from the high-boiling isomerized residue suitable for the formation of the lubricating base. Said low-boiling fraction is then joined to the product of the above isomerization step and sent downstream to the fractionated distillation column, or sent, at least partially, to said isomerization step, with the purpose of further increasing the quality of the middle distillate thus obtained, particularly of the kerosene fraction.

Figure 2:
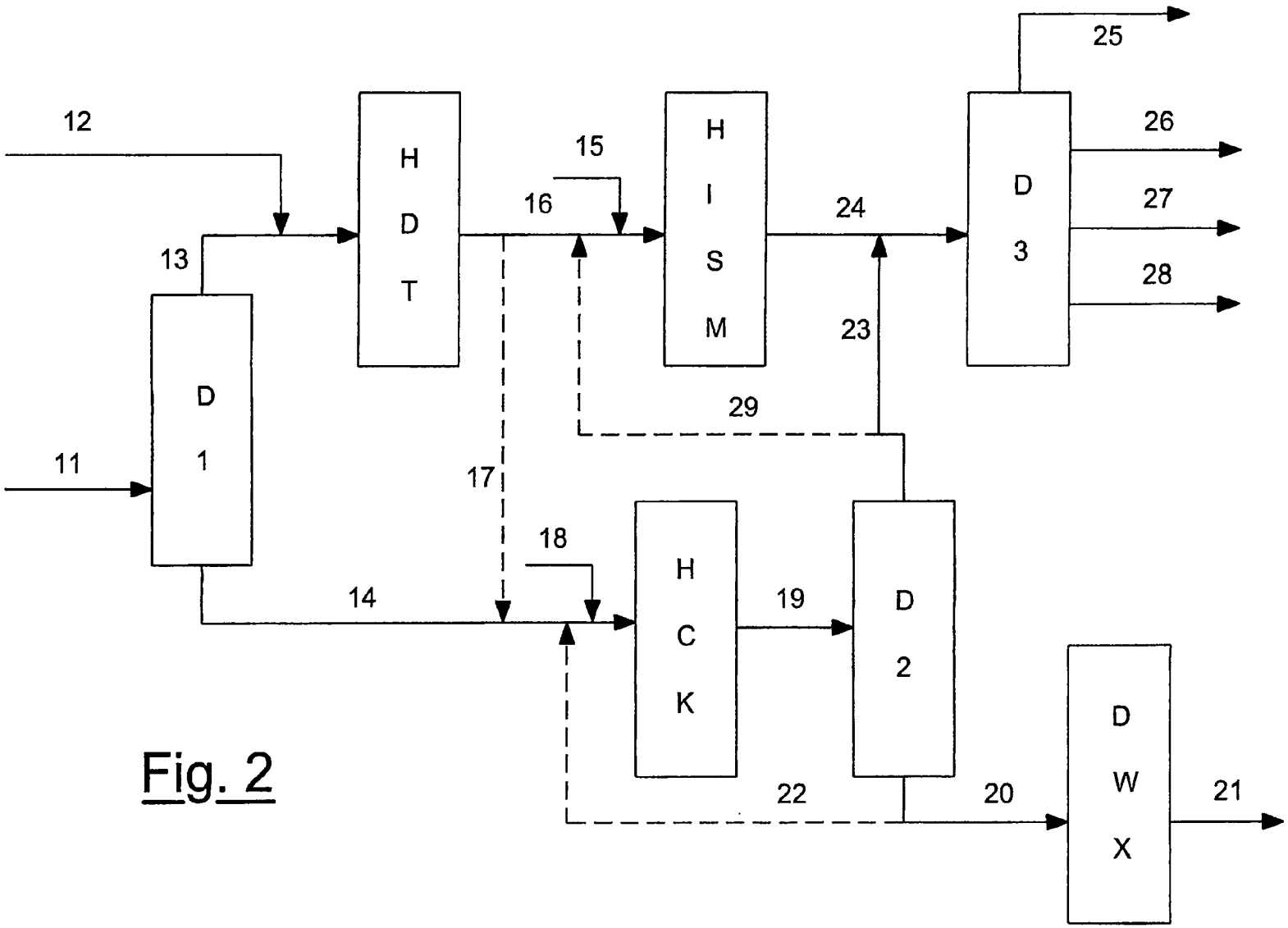

Some possible embodiments of the process according to the present invention are described hereunder with reference to FIGS. 1 and 2, without limiting in any way the overall scope of the invention as claimed herein.

In particular:

FIG. 1 schematically illustrates a plant for the embodiment of the process according to the present invention, comprising a hydrocracking step and a distillation step of the product mix obtained;

FIG. 2 schematically illustrates a particular case of the plant of FIG. 1, wherein the distillation residue is further treated to improve its performance as lubricating base.

According to the plant scheme of FIG. 1, a stream 1 of substantially linear and preferably sulphur-free hydrocarbons, obtained, for example, from a Fischer-Tropsch process, preferably of the non-shifting type, is fed to the hydrocracking unit (HCK) of step (i) of the present process together with the necessary amount of hydrogen, through line 2.

An aliquot of residue 8 is also possibly fed to the same unit, through line 9, coming from the subsequent separation of the middle distillate, preferably having a boiling point over 350° C., in a mass ratio preferably ranging from 0 to 90%, more preferably between 10 and 30% with respect to the total residue volume.

The reaction product of the hydrocracking step, consisting of a hydrocarbon mix having an isomerization degree (non-linear hydrocarbon mass/mixture mass) preferably over 50%, more preferably over 70%, is fed, through line 3, to a separation step by distillation (DIST), preferably in a suitable column running at atmospheric pressure or slightly higher, from which the middle distillates, suitable as fuels according to the present invention, are collected by means of line 6 (kerosene) and 7 (gas oil). From the unit DIST in FIG. 1, the following products are also obtained: through line 4 a gaseous fraction C1-C5, of little significance, and, through line 5, a hydrocarbon light fraction, preferably having a boiling point lower than 150° C. (naphtha), in an overall amount advantageously lower than 20% by weight, preferably lower than 15%, with respect to the hydrocarbon mix fed through line 1.

According to a particularly distinct aspect of the present invention, the use of the above catalyst supported on a silico-alumino-phosphatic amorphous solid in the hydrocracking step (i), allows a high quality middle distillate fraction to be obtained, with a high yield (low production of 150−° C. volatile products), also having, in particular, excellent low temperature properties and a high cetane number, together with a high-boiling residue having a surprisingly low content of linear paraffins, which is particularly suitable for obtaining lubricating bases, either as such or, preferably, after dewaxing treatment with advantageously reduced contact times and conversions.

A particularly preferred embodiment of the process according to the present invention is schematically shown in the scheme of FIG. 2.

A liquid stream 11, consisting of a mix of light hydrocarbons coming from a Fischer-Tropsch synthesis process, also including unsaturated products (linear olefins) in a quantity of up to 10%, preferably from 2 to 5% by weight, and oxygenated products (mainly alcohols), in an amount of up to 10% by weight, preferably from 2 to 7% by weight, is separated in the distillation column D1 into a light fraction 13 having a final boiling point lower than 380° C., preferably between 260 and 360° C., and a heavy fraction 14, consisting of the distillation residue. The distillation in D1 preferably only has one step (flash) and can be substituted by a differentiated collection of two fractions directly from the Fischer-Tropsch synthesis reactor.

The mass ratio of the fractions 13 and 14 is preferably included within the range of 0.5 to 2.0, more preferably from 0.8 to 1.5.

The light fraction 13 is fed to a hydro-isomerization (HDSM) unit. It can however represent a drawback for the functioning of the catalysts in this step, especially in the case of the presence of heteroatoms or unsaturated groups, and oxygenated products in particular, said fraction 13 is preferably fed to a hydrogenation unit (HDT) in which it is put in contact with hydrogen (line 12) in the presence of a suitable catalyst, under such conditions as to minimize or nullify the hydrocracking reaction. The hydrogenation unit (HDT) can be produced according to the known technique and preferably comprises a pressure reactor containing a catalyst on a fixed bed, selected from those suitable for the purpose mentioned above. Typical hydrogenation catalysts suitable for the purpose comprise a hydrogenating metal such as Ni, Pd or Pt supported on an inert solid or having an acidic activity, such as alumina, silica, silico-alumina, zeolites or molecular sieves. It may occur that during hydrogenation there is an isomerization and partial hydrocracking reaction, generally limited to a conversion lower than 155% by weight with respect to the total weight of the fraction fed. The small fraction of volatile compounds (150−° C.) and water possibly formed can be optionally separated by means of distillation. The hydrogenated or non-hydrogenated light stream, according to the case, is then sent to a hydro-isomerization (HDSM) step through line 16, in which it is reacted, in the presence of hydrogen, under the usual conditions suitable for obtaining a widespread isomerization and a partial breaking of the linear hydrocarbon chains. Suitable conditions for the isomerization are listed in detail in the art, together with a large number of catalysts.

An aliquot, normally lower than 50%, preferably between 0 and 25% of said light fraction, can be possibly removed, through line 17, before the isomerization step, and mixed again with said heavy fraction of line 14 to be subjected to hydrocracking.

In said isomerization step, hydrogen is added to the hydrocarbon mix (line 15) in an amount of between 150 and 1500 normal-liters per liter of liquid and the mix is passed on a fixed bed of a suitable bi-functional catalyst with a hydro-dehydrogenating activity, preferably consisting of an extruded product comprising from 30 to 70% by weight of amorphous micro/meso-porous silico-alumina, and from 0.2 to 1% by weight of platinum or palladium, with a space velocity of between 0.1 and 10 $h^{-1}$, at a temperature ranging from 300 to 450° C. and a pressure of between 1 and 10 MPa. The isomerization step is preferably effected so as to convert at least 60%, preferably at least 80% by weight of linear hydrocarbons into isomerized hydrocarbons, at the same time maintaining the amount of product having a boiling point higher than 150° C. converted to a product with a lower boiling point, below 30%, preferably 20% by weight, so as to limit the extension of the cracking.

The isomerized mix is sent, through line 24 to a fractionation column D3, after being joined to at least a part of the light fraction 23 coming from the distillation column D2 of the heavy fraction subjected to hydrocracking. A middle distillate is obtained, according to the present invention, from column D3, possibly collected at two different levels in order to separate the kerosene (line 27) from the gas oil (line 28), having excellent low temperature properties, a high cetane number, preferably over 50, and a reduced emission of polluting agents.

In particular, it has been found that it is possible to obtain, by means of the present process, middle distillates having the following characteristics:

| | Kerosene (150-250° C.) |
|---|---|
| Smoke point | >50 mm |
| Flash point | >40° C. |
| Freezing point | <−47° C. |
| Aromatic compounds | <0.1% |
| Sulphur | <0.1 ppm |
| | **Gas oil (250-360° C.)** |
| B.C.N. | >70 |
| Flash point | >160° C. |

-continued

| | |
|---|---|
| Pour point | <−12° C. |
| Aromatic compounds | <0.1% |
| Sulphur | <0.1 ppm |

Small amounts of low molecular weight products are obtained from the distillation and fractionation column D3, particularly through line 25, a gaseous fraction C1-C5, of low interest, and, through line 26, a light fraction of hydrocarbon, preferably having a boiling point lower than 150° C. (naphtha). According to a particularly advantageous aspect of the present invention, the amount of said volatile fractions is significantly reduced with respect to similar processes of the art, preferably to less than 20%, more preferably less than 15% by weight with respect to the initial feed of line 1.

The necessary amount of hydrogen (line 18) is added to the fraction (line 14) of high boiling hydrocarbons with a low oxygen content and unsaturated, and fed to the hydrocracking (HCK) unit according to step (i) of the present process, according to what has already been seen with respect to the simplified scheme of FIG. 1. The product obtained is sent, through line 19, to a distillation and fractionation apparatus D2, which is preferably run so as to obtain a separation of the hydrocarbon mix essentially into two fractions:

F1 a light fraction, with a boiling point lower than 380° C., preferably lower than 360° C., preferably including less than 10% by weight of volatile products (150−° C) consisting of a product with a high iso-paraffin concentration, which is sent, through line 23, to the same fractionation step of the light fraction 24 isomerized in (HISM);

F2 a residual fraction, consisting of a mix of isomerized high-boiling hydrocarbons, surprisingly having a reduced content of waxes with respect to the products obtained by means of other catalysts of the known art, under similar conditions, whose initial boiling point is higher than 320° C., preferably higher than 340° C.

The combination of the two streams 23 and 24, coming from steps carried out with different feeds and under different conditions, but complementary, allows kerosene and gas oil fractions having the excellent properties listed above, to be advantageously obtained, after suitable distillation in D3. An aliquot, when necessary, preferably less than 50% by weight, of the mix F1 coming from distillation D2, is sent, through line 29, to the same isomerization step (HISM), in order to further increase the degree and distribution of the isomerizations, and regulate the relative amount of the gas oil and kerosene produced.

The residual fraction F2 can be used as such for particular uses, or is preferably sent (line 20) to a dewaxing (DWX) step for producing lubricating bases. According to a preferred aspect, it is partially recycled to the hydrocracking step (HCK) through line 22, for regulating the productivity of the process or varying the isomerization degree according to the production demands.

The isomerization degree of the residual fraction sent to line 20 is preferably higher than 85%.

As the amount of linear paraffins is reduced, the dewaxing step, when necessary, can be advantageously effected, according to the process of the present invention, under particularly favourable contact time and lubricating base yield conditions.

Said dewaxing step (DWX) can be effected according to the known techniques, both with a solvent and, preferably, in the presence of a catalyst suitable for the purpose. In this latter case, the partially isomerised mix is again reacted, in the presence of hydrogen and a suitable solid catalyst, preferably comprising a metal with a hydro-dehydrogenating activity, usually a noble metal, supported on a zeolite or other crystalline porous solid.

In this case, contrary to what takes place in solvent dewaxing, where the paraffin crystals are physically separated, the paraffins are selectively transformed into iso-paraffin compounds or lighter cracking products, according to the catalyst used. The cracking products are mainly low molecular weight paraffins and olefins, partially (up to 50% by weight) consisting of C5-compounds, the remaining part being a material having a molecular weight within the gasoline range.

The catalytic materials mostly used are medium pore zeolites (such as mordenite, ZMS-5, SAPO-11) and, in some cases, larger pore materials (such as beta zeolites and HY), but also other materials have been proposed.

The catalytic dewaxing can be effected, according to use, at pressures which can vary from 2 to 20 MPa, offering higher operative pressures, advantages in terms of catalyst life cycle, higher yields and viscosity indexes of the de-waxed products. The preferred temperature conditions WABT and space velocity LHSV are those typical of hydrotreating, the WABT ranging from 315 to 400° C. and LSHV from 0.3 to 1.5 $h^{1}$.

Downstream of the catalytic dewaxing, a treatment is normally envisaged on a typical "finishing" catalyst for improving the colour and removing any traces of reactive molecules, such as olefins, in order to confer a better stability to the product.

At the end of said dewaxing step, after removing the last residues (<3% by weight) of volatile products formed as a result of the partial hydrocracking, a liquid, isomerized product is obtained (line 21) having excellent properties at low temperatures and a high viscosity, having an initial boiling point of over 350° C., preferably >360° C. and with a distillation temperature (extrapolated) of 90% of the mix (T90) lower than 700° C. (by extrapolation).

Some examples of practical embodiments are provided for a more detailed description of the present invention, which however are purely illustrative of some of the particular aspects of the invention and should in no way be considered as limiting its overall protection scope.

EXAMPLES

The following analysis and characterization methods were used for running the practical embodiments of the present invention:

X-ray diffractometry from powders (XRD): the analysis was carried out using a vertical Philips X'PERT diffractometer equipped with a proportional pulsation meter and a secondary curved graphite crystal monochromator; two different measurements were effected for each sample: the first in the angular region $1.5 \leqq 2\theta \leqq 10°$ with a step of 0.05° 2θ and accumulation times of 20s/step and fixed divergent slips of ⅙°; the second within the spectral range of $3 \leqq 2\theta \leqq 53°$ with a step of 0.05° 2θ and accumulation times of 10s/step and fixed divergent slips of 1°; in both cases the radiation was CuKα (λ=1.54178 Å).

The information on the characteristics of the catalysts under examination are deduced from the evaluation of the adsorption/desorption isotherms of $N_2$ at the temperature of the liquid $N_2$, obtained by using a ASAP 2010 instrument (Micrometrics) and a Sorptomatic 1990. The samples (~0.3 g) have been degassed for 16 hours at 350° C. at reduced pressure, before the acquisition of the isotherms.

The total specific pore volume ($V_p$) was calculated using the Gurvitsch method at p/p°=0.995. When the adsorption isotherms end with a plateau, it is possible to exclude phenomena due to macropores or interparticles porosity, therefore a precise determination of this parameter is possible. When the isotherms do not end with a plateau, $V_p$ is only indicative.

Measurement of the pore dimensions: the average pore diameter was determined by means of the DFT (density functional theory) method, of which details are provided in the publication of P. A. Webb and C. Orr, in "Analytical Methods in Fine Particle Technology", Micrometrics Instruments Corp. (1997), page 81.

Measurement of the specific surface area: the specific surface area was evaluated by means of the BET linear graph with two parameters within the range of p/p° 0.01-0.2 applying the DFT (density functional theory) method.

Pour point: according to the regulation ASTM D97

Viscosity at 100 cSt: according to the regulation ASTM D445

Viscosity index: according to the regulation ASTM D2270

Reagents and Materials

The commercial reagents listed below were used during the preparations described in the examples:

| | |
|---|---|
| tetrapropyl ammonium hydroxide (TPA-OH) | SACHEM |
| aluminum tri-isopropoxide | FLUKA |
| tetra-ethyl silicate | DYNAMIT NOBEL |
| alumina (VERSAL 250, Pseudo-Bohemite) | LAROCHE |
| methyl cellulose (METHOCEL) | FLUKA |
| phosphoric acid | CARLO ERBA |

The reagents and/or solvents used and not indicated above are those most commonly used and can be easily found at the normal commercial suppliers specialized in the field.

Example 1

Catalyst with P/Al=1

239.50 ml of demineralized water, 3.40 g of an ammonia solution at 30% by weight and 2.30 g of a solution of phosphoric acid at 85% by weight (equivalent to 0.02 moles of tri-ammonium phosphate $(NH_3)_3PO_4$), are charged into a three-necked flask, equipped with a rod stirrer and a bubble cooler. 50.80 g of an aqueous solution at 40% by weight of tetrapropyl ammonium hydroxide (TPA-OH, 0.01 moles) and 4.08 g of aluminum tri-isopropoxide (0.02 moles) are added to the mixture thus prepared. The mixture is maintained under stirring at room temperature for about 60 minutes, until a limpid solution is obtained. 208 g of tetra-ethyl or thosilicate (TEOS; 1.00 moles) are rapidly added to this solution and the temperature is brought to 60° C., the whole mixture being maintained under stirring under these conditions for a further 3 hours. At the end the formation of a gel is observed, which is cooled to room temperature and left to rest for 20 hours. In this way a homogeneous gel is obtained, characterized by the following molar ratios between the constituents: Si/Al=51; TPA-OH/Si=0.098; $H_2O$/Si=15; Si/P=50.

The gel thus obtained is first dried in air for about 3 hours and then calcined by heating, still in a stream of air, at 550° C.

for 5 hours. At the end, an amorphous solid is obtained according to the present invention, identified by the following empirical formula: $SiAl_{0.02}P_{0.02}O_{2.08}$.

The complete absence of crystalline aggregates was confirmed by means of X-ray diffraction. By means of NMR spectroscopy applied to the $^{31}P$ and $^{27}Al$ isotopes, it was found that at least 80% of the phosphorus is bonded by Al—O—P bonds to the amorphous silico-alumina matrix. The results of the morphological analysis are summarized in Table 1 below.

Examples 2 and 3

The procedure according to the previous example 1 was repeated modifying each time the quantity of tri-ammonium phosphate initially produced by mixing ammonia and phosphoric acid in aqueous solution, so that the P/Al ratio in the gel ranges from 0.5 to 2 for Examples 2 and 3, respectively.

The results of the morphological analysis and elemental analysis are summarized in Table 1 below.

Example 4

The procedure of Example 1 was repeated exactly, with the only difference that the hydrolysis and gelation step is carried out in an ethanol/water mixture in which the molar ratios ethanol/$SiO_2$=8 and $H_2O/SiO_2$=8. At the end the product thus obtained is subjected to characterization according to the above techniques. The morphological data are indicated in Table 1 below.

Example 5

239.50 ml of demineralized water, 6.78 g of an ammonia solution at 30% by weight and 4.59 g of a solution of phosphoric acid at 85% by weight (equivalent to 0.040 moles of tri-ammonium phosphate $(NH_3)_3PO_4$), are charged into a three-necked flask, equipped with a rod stirrer and a bubble cooler. 50.8 g of an aqueous solution at 40% by weight of tetrapropyl ammonium hydroxide (TPA-OH, 0.10 moles) and 8.13 g of aluminum tri-isopropoxide (0.04 moles) are added to the mixture thus prepared. The mixture is maintained under stirring at room temperature for about 60 minutes, until a limpid solution is obtained. 208 g of tetra-ethyl or thosilicate (TEOS; 1.00 moles) are rapidly added to this solution and the procedure is the same as in the previous example 1. At the end, an amorphous solid is obtained according to the present invention, identified by the following empirical formula: $SiAl_{0.02}P_{0.02}O_{2.08}$. which is characterized according to the above-mentioned techniques. The morphological data are shown in Table 1 below.

The structure of the solid catalysts obtained in accordance with the previous examples 2 to 5 was determined, as for the product obtained in accordance with example 1, by means of X rays diffraction and NMR spectroscopy, and proved to be completely amorphous solids wherein at least 80% of phosphorus is bonded by means of Al—O—P links to the silico-alumina matrix.

Example 6 (Comparative)

The procedure of Example 1 was repeated exactly, with the only difference that the P/Al ratio in the gel was equal to 5, instead of 1.

The structure of the solid thus obtained, determined by means of X-ray diffraction and NMR spectroscopy, proved to be analogous to that of the product of Example 1, but the pore structure was greatly modified, with a partial collapse of the same, as shown by the significant reduction in their volume.

Example 7 (Comparative)

An amorphous silica-alumina solid support was prepared not containing phosphorus, repeating the same procedure as the previous Example 1, but without introducing the solution of tri-ammonium phosphate. The results of the characterization are summarized in Table 1 below. A significant reduction in the average pore diameter is observed.

TABLE 1

Morphological properties of the catalysts

| Example | Si/Al | P/Al | $S_{BET}$ ($m^2/g$) | Vp (ml/g) | $d_{DFT}$ (nm) |
|---|---|---|---|---|---|
| 1 | 50 | 1.0 | 700 | 0.96 | 6.1 |
| 2 | 50 | 0.5 | 720 | 0.84 | 5.3 |
| 3 | 50 | 2.0 | 520 | 1.62 | 25.0 |
| 4 | 50 | 2.0 | 760 | 1.57 | 13.0 |
| 5 | 25 | 1.0 | 500 | 1.35 | 19.0 |
| 6 (comp.) | 50 | 5 | 80 | 0.06 | — |
| 7 (comp.) | 50 | 0 | 760 | 0.49 | 2.3 |

Example 8

Extruded Catalyst 5 kg of a humid gel prepared by exactly repeating the procedure of the previous Example 1, but omitting the drying and calcination step, 1.466 kg of alumina (pseudo-bohemite, VERSAL 150), previously dried for 3 hours in air at 150° C., and 0.205 kg of methyl cellulose are charged into a 10 litre plough mixer, maintained at a stirring rate of 70-80 revs per minute, and the mixture is left under stirring for about 1 hour. 50 ml of glacial acetic acid are then added and the temperature of the mixer is brought to about 60° C., continuing the stirring until a homogeneous paste is obtained, having the desired consistency for the subsequent extrusion. The mixture is charged into an extruder of the HUTT type, extruded and cut into cylindrical pellets of the desired size (about 2×4 mm). The product is left to rest for about 6-8 hours and then dried by maintaining it in a stream of air at 100° C. for 5 hours. It is finally calcined in a muffle at 550° C. for 5 hours in a stream of air.

A porous extruded solid is thus obtained, with acidic characteristics (indicated hereunder with the term "extruded product" for the sake of simplicity), essentially consisting of an amorphous silica/alumina/phosphate phase (60% by weight, by means of X-ray diffraction) and an alumina crystalline phase (pseudo-bohemite), whose morphological characteristics are specified in Table 2 below.

Examples 9, to 12 and 13 (Comparative)

The same procedure was repeated as the previous Example 8, but substituting the amorphous solid prepared according to Example 1 with the solids prepared according to the respective examples as indicated in the second column of Table 2 below.

Porous extruded solids are thus obtained, whose morphological characteristics are specified in Table 2.

TABLE 2

Morphological properties of the extruded products

| Example | Amorphous phase (Example Nr.) | P/Al | $S_{BET}$ ($m^2/g$) | Vp (ml/g) | $d_{DFT}$ (nm) |
|---|---|---|---|---|---|
| 8 | 1 | 1 | 540 | 0.91 | 7.6 |
| 9 | 3 | 2 | 460 | 1.26 | 18.0 |
| 10 | 4 | 2 | 510 | 1.25 | 16.0 |
| 11 | 2 | 0.5 | n.d. | n.d. | n.d. |
| 12 | 5 | 1 | 400 | 1.12 | 18.0 |
| 13 (comp) | 7 | 0 | 590 | 0.88 | <6.0 |

Example 14

Formation of a Hydrocracking Catalyst Based on Platinum

In order to demonstrate the advantageous properties of the amorphous solid of the present invention as a catalytically active support in hydrotreatment processes of hydrocarbons, a hydrocracking catalyst was prepared, containing platinum as hydro-dehydrogenation metal.

In order to disperse the platinum on the support an aqueous solution of hexa-chloro platinic acid ($H_2PtCl_6$), hydrochloric acid and acetic acid was used in the following molar ratios: $H_2PtCl_6/HCl/CH_3COOH$=1/0.84/0.05, having a platinum concentration of $7.69 \cdot 10^{-3}$ M. 60 ml of this solution were added to 30 g of the extruded solid, obtained according to the previous Example 8, so that the whole solid was covered by the solution, in order to avoid heterogeneity in the platinum distribution. The suspension thus obtained was maintained under stirring for about an hour and then degassed by suction under vacuum (about 1 kPa) at room temperature. The solvent was subsequently removed by heating to about 70° C. in a stream of air. The dry product was finally calcined in a stream of air with the following temperature profile 25-350° C. in 2 hours, to 350° C. for 2 hours, 350-400° C. in 50 min., to 400° C. for 3 hours.

At the end, a supported catalyst for hydrocracking is obtained, having the following characteristics:

59.8% by weight of active amorphous solid (molar ratio Si/Al=51, P/Al=1)

39.9% by weight of gamma-alumina 0.3% by weight of platinum

Examples 15, 16 and 17 (Comparative)

A further three samples of hydrocracking catalyst were prepared, exactly repeating the procedure of the previous Example 14, but using the extruded products according to Examples 9, 10 and 13 (comparative), in Examples 15, 16 and 17 (comparative), respectively. The composition characteristics relating to amorphous phase, gamma-alumina and platinum content of the catalysts obtained are essentially the same as Example 14, whereas the morphological measurements are specified in Table 3 below.

TABLE 3 morphological characteristics of the catalysts with 0.3% Pt

| Example | P/Al | $S_{BET}$ ($m^2/g$) | Vp (ml/g) | $d_{DFT}$ (nm) |
|---|---|---|---|---|
| 14 | 1 | 490 | 0.84 | 7.3 |
| 15 | 2 | 430 | 1.12 | 15.0 |
| 16 | 2 | 470 | 1.02 | 16.0 |
| 17 (comp) | 0 | 510 | 0.82 | n.d. |

Example 18

120 ml of the aqueous solution of hexa chloroplatinic acid used in the previous examples ($H_2PtCl_6/HCl/CH_3COOH$=1/0.84/0.05, [Pt]=$7.69 \cdot 10^{-3}$ M), were added to 30 g of the extruded solid obtained according to the previous Example 8, so that the whole solid is covered by the solution, in order to avoid heterogeneity in the platinum distribution. The suspension thus obtained was treated with the same procedure described in the previous Example 14, to obtain at the end, after calcination, a supported catalyst for hydrocracking, having the following characteristics:

59.8% by weight of active amorphous solid (molar ratio Si/Al=51, P/Al=1)

39.9% by weight of gamma-alumina 0.59% by weight of platinum

Examples 19, 20 and 21 (Comparative)

Three further samples of catalyst for hydrocracking were prepared, containing 0.6% by weight of platinum, by exactly repeating the process of the previous example 18, but using the extruded products in accordance with the examples 11, 12 and 13 (comparative), in the examples 19, 20 and 21(comparative), respectively. The composition characteristics relating to amorphous phase, gamma-alumina and platinum content of the catalysts obtained are essentially the same as Example 18, whereas the morphological characteristics do not significantly differ from those of the original active support.

Examples 22 to 26

Various hydrocracking tests were carried out on a mix of paraffins, solid at room temperature, obtained through the Fischer-Tropsch synthesis, using the catalysts of the previous Examples 18 to 21.

The hydrocracking tests were effected in a fixed bed tubular reactor having a useful charge volume of 15 ml, corresponding to a height of the catalytic bed in the isotherm section of about 10 cm. The reactor is equipped with suitable connections for the continuous cocurrent feeding of the reagents and the removal of the reaction mixture. Hydrogen is fed at the desired pressure by means of a mass flow meter; the mixture of paraffins is maintained in the liquid state at a temperature of about 110° C. and fed by means of a pump.

The temperature of the reactor is controlled by means of a thermostat system capable of operating at up to 400° C. An adequate analytical instrumentation is connected on line for analysis in real time of the composition of the reaction product.

8 g of catalyst are charged into the reactor and activated according to the method described above.

A 370+° C. cut of a mixture of paraffins, obtained through a Fischer-Tropsch synthesis, having the following composition, was used as feeding:

| | |
|---|---|
| Fraction < 150° C. | 0.0 |
| Kerosene (from 150 to 260° C.) | 0.3 |
| Gas oil (from 260 to 370° C.) | 1.9 |
| Fraction > 370° C. | 97.8 |

Various hydrocracking tests were carried out on said paraffinic composition, at a total pressure of about 5 MPa and a weight ratio hydrogen/(hydrocarbon mixture) of about 0.1. Table 4 below indicates the experimental conditions and catalysts used in Examples 22 to 26. The contact time (1/WHSV) was regulated according to the usual technique in order to have the desired conversion degrees at the end.

TABLE 4

| Process conditions | | | | | |
|---|---|---|---|---|---|
| Conditions | Ex. 22 | Ex. 23 | Ex. 24 | Ex. 25 | Ex. 26(*) |
| Temperature (° C.) | 355 | 335 | 345 | 340 | 345 |
| $H_2$/waxes (w/w) | 0.105 | 0.105 | 0.105 | 0.105 | 0.105 |
| Pressure (MPa) | 5.0 | 5.0 | 5.0 | 5.0 | 5.0 |
| Catalyst (Ex. Nr) | Ex. 18 | Ex. 19 | Ex. 20 | Ex. 19 | Ex. 21(*) |
| P/Al (atom/atom) | 1 | 0.5 | 1 | 0.5 | 0 |
| Si/Al (atom/atom) | 51 | 51 | 25 | 51 | 51 |
| WHSV ($h^{-1}$) | 2 | 2 | 2 | 2 | 2 |

(*)comparative mixture is filtered at a temperature of −20° C. The de-waxed product is separated from the solvent by distillation under vacuum and subsequent stripping in a stream of nitrogen at 80° C.

The quantity of product obtained is measured to determine the content of lubricating base of said 360+ residue. The lubricating base is then characterized by measuring the viscosity at 100° C. and the viscosity index. The results are indicated in Table 5 below, which clearly demonstrates the surprising improvements obtained with the catalytically active support of the present invention, with respect to a silica-alumina support having an analogous composition but not containing phosphorus. In particular, according to Examples 22 to 25 in accordance with the present invention, it is possible to obtain, by means of a single hydrocracking step, a high yield to middle distillates (columns 150-260 and 260-370) and a high-boiling residue containing over 80% by weight of lubricating base having a much higher viscosity than that obtained under the same process conditions with a catalyst of the known art (comparative Example 26).

In addition to the above, other possible embodiments or equivalent modifications of the present invention which are not specifically mentioned herein, should be considered as being simple variations of the same and, in any case, included within the scope of the following claims.

TABLE 5

Composition and properties of the hydrocracking products.

| | | | | Yields to hydrocracking products (w %) (distillation ranges of fractions in ° C.) | | | | Lubricating base | | |
|---|---|---|---|---|---|---|---|---|---|---|
| Ex. | Temp. (° C.) | WHSV ($h^{-1}$) | Convers $C_{22}$+ | <150 | 150-260 | 260-370 | >370 | Yield % of 360+ residue | Viscosity at 100° C. (cSt) | Viscosity index |
| 22 | 335 | 2 | 80.27 | 23.4 | 24.180 | 32.2 | 19.3 | 99 | 5.23 | 143 |
| 23 | 335 | 2 | 63.8 | 17.1 | 22.714 | 23.972 | 36.034 | 96 | 5.97 | 157 |
| 24 | 345 | 2 | 69.6 | 22.6 | 20.332 | 26.808 | 30.189 | 87 | 5.47 | 145 |
| 25 | 340 | 2 | 73.3 | 19.7 | 23.657 | 30.416 | 26.137 | 100 | 5.34 | 148 |
| 26(*) | 345 | 2 | 77.5 | 20.9 | 26.151 | 30.842 | 21.981 | 86 | 4.56 | 142 |

(*)Comparative

A fractionation was effected on the outgoing mixture by means of gas-chromatographic analysis, and on this basis, the conversion degree is measured of the hydrocarbon fraction having more than 22 carbon atoms $C_{22}$+, corresponding, more or less, to the fraction with a boiling point >370° C. Table 5 below indicates the composition data relating to the yields in the various distillation cuts obtained at the end of the process.

An aliquot of the hydrocracking products is distilled at 360° C. and the content of lubricating base is determined on the residue, according to the method explained herebelow. The 360+ residue is dissolved at 40° C. in a 1/1 vol/vol mixture of methyl-ethyl ketone and toluene. The (solvent)/(360+ residue) ratio is 4/1 vol/vol; an aliquot of the solvent (about ⅛ of the total) is used in the washing step of the paraffin collected on the filter. The temperature of the solution is lowered to −20° C. at a rate of 1° C./min. At the end, the

The invention claimed is:

1. A process for the contemporaneous preparation of middle distillates and a high boiling residue suitable for producing lubricating bases starting from a feedstock of a hydrocarbon mixture comprising at least 80% by weight linear paraffins obtained by means of a Fischer-Tropsch type synthesis process from hydrogen and carbon monoxide, comprising at least 30% of a high-boiling fraction with a distillation temperature higher than 360° C., comprising:

(i) at least one hydrocracking step, wherein said hydrocarbon mix is reacted with hydrogen at a temperature of between 200 and 450° C. and a pressure of between 0.5 and 15 MPa, in the presence of a catalyst, for a time sufficient for converting at least 40% of said high-boiling fraction, into a fraction of hydrocarbons which can be distilled at temperatures lower than 360° C.;

(ii) at least one distillation step of the product of step (i) for separating at least a fraction of middle distillate and at least one high-boiling residue suitable for producing a lubricating base with an initial boiling point equal to or higher than 340° C., wherein said hydrocracking step (i) is effected in the presence of a supported catalyst comprising:

(A) a support of an acidic nature consisting of a catalytically active porous solid, including silicon, aluminum, phosphorus and oxygen bonded to one another in such a way as to form a mixed amorphous solid forming a single phase, characterized by an Si/Al atomic ratio of between 15 and 250, a P/Al ratio of at least 0.1, but lower than 5,a total pore volume ranging from 0.5 to 2.0 ml/g, an average pore diameter ranging from 3 nm to 40 nm, and a specific surface area ranging from 200 to 1000 $m^2/g$;

(B) at least one metal with a hydro-dehydrogenating activity selected from groups 6 to 10 of the periodic table of elements, dispersed on said support (A) in an amount of between 0.05 and 5% by weight with respect to the total weight of the catalyst.

2. The process according to claim 1, wherein said active support of the catalyst has a total pore volume of between 0.7 and 1.7 ml/g, a surface area of between 300 and 900 $m^2/g$ and an average pore diameter of between 5 and 30 nm, an Si/Al ratio ranging from 20 to 200 and a P/Al ratio ranging from 0.3 to 3.5.

3. The process according to claim 1, wherein the difference between 10% and 90% in the distribution curve of the pore dimensions of said active support of the catalyst, in included within a diameter range of between 2 and 40 nm.

4. The process according to claim 1, wherein said catalyst comprises, in addition to said active support (A) a binder consisting of an inert inorganic solid.

5. The process according to claim 4, wherein said inert binder is selected from the group consisting of silica, alumina, clay, titanium oxide ($TiO_2$) or zirconium oxide ($ZrO_2$), boron oxide ($B_2O_3$) and mixtures thereof.

6. The process according to claim 4, wherein said binder is in an amount of 1 to 70% by weight with respect to the weight of said inert binder and said amorphous support (A).

7. The process according to claim 4, wherein said catalyst is in the form of pellets having dimensions of around 2-5 mm in diameter and 2-10 mm in length.

8. The process according to claim 1, wherein said metal in component (B) of the catalyst is selected from the group consisting of nickel, molybdenum, tungsten, cobalt, platinum, palladium and mixtures thereof.

9. The process according to claim 1, wherein the concentration of said metal having a hydro-dehydrogenating activity ranges from 0.2 to 1% by weight with respect to the total weight of said catalyst.

10. The process according to claim 1, wherein said feeding mix consists for at least 80% by weight of linear paraffins having from 5 to 80 carbon atoms and an initial boiling point of between 45 and 675° C. (by extrapolation).

11. The process according to claim 1, wherein said feeding mix comprises from 40 to 80% by weight of a high-boiling fraction which can be distilled at temperatures ≧360° C. and from 20 to 60% by weight of middle distillate.

12. The process according to claim 1, wherein said feeding mix has an initial boiling point of at least 260° C.

13. The process according to claim 1, wherein said hydrocracking step (i) is run at a temperature of between 300 and 370° C. and at a pressure of between 1 and 10 MPa, including the hydrogen pressure.

14. The process according to claim 1, wherein said hydrocracking step (i) is effected with an initial (hydrogen) / (hydrocarbons) mass ratio of between 0.03 and 0.2.

15. The process according to claim 1, wherein the αconversion in said hydrocracking step (i) ranges from 60 to 90%.

16. The process according to claim 1, wherein an aliquot of said high-boiling residue obtained in said step (ii) is recycled to the hydrocracking step (i).

17. The process according to claim 1, wherein said high-boiling residue used for the production of lubricating bases is subjected to a de-waxing treatment.

18. The process according to claim 17, wherein said dewaxing step consists of a catalytic dewaxing.

19. The process according to claim 1, comprising, in addition, a hydrogenating treatment of the feed to said hydrocracking step (i).

20. The process according to claim 1, wherein, before the hydrocracking step, a light fraction having a final boiling point lower than 380° C. is separated from said feed, by distillation, before the hydrocracking step.

21. The process according to claim 20, wherein said light fraction is subjected to a hydroisomerization treatment in the presence of a suitable bi-functional catalyst with a hydro dehydrogenating activity to obtain an isomerized mix.

22. The process according to claim 21, wherein said light fraction is subjected to a hydrogenating treatment, before the hydro-isomerization treatment.

23. The process according to claim 20, wherein said light fraction or a product obtained therefrom, is joined to at least a part of said fraction of middle distillate obtained in step (ii) and sent to a fractionation step for the production of at least one fraction of middle distillate.

* * * * *